US011308877B2

(12) United States Patent
Lee et al.

(10) Patent No.: US 11,308,877 B2
(45) Date of Patent: Apr. 19, 2022

(54) DISPLAY DRIVING DEVICE AND DISPLAY DEVICE INCLUDING THE SAME

(71) Applicant: Silicon Works Co., Ltd., Daejeon (KR)

(72) Inventors: Jeong Lee, Daejeon (KR); Sung Ha Kim, Daejeon (KR); Yong Sung Ahn, Daejeon (KR); Kyung Min Shin, Daejeon (KR); Jung Ryeol Park, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 16/953,668

(22) Filed: Nov. 20, 2020

(65) Prior Publication Data

US 2021/0150981 A1 May 20, 2021

(30) Foreign Application Priority Data

Nov. 20, 2019 (KR) ..... 10-2019-0149766

(51) Int. Cl.
*G09G 3/3233* (2016.01)

(52) U.S. Cl.
CPC ... *G09G 3/3233* (2013.01); *G09G 2300/0809* (2013.01); *G09G 2330/028* (2013.01)

(58) Field of Classification Search
CPC ..... G09G 3/3233; G09G 2300/0809; G09G 2330/028
See application file for complete search history.

(56) References Cited

U.S. PATENT DOCUMENTS

2006/0125408 A1* 6/2006 Nathan ..... G09G 3/3241 315/169.3
2006/0267508 A1* 11/2006 Sun ..... G09G 3/3233 315/169.3
2011/0210985 A1* 9/2011 Zipnick ..... G09G 5/346 345/660
2011/0227903 A1* 9/2011 Choi ..... G09G 3/3291 345/212
2017/0031485 A1* 2/2017 Kim ..... G09G 3/3275
2017/0365218 A1* 12/2017 Jeong ..... G09G 3/3225
2018/0190198 A1* 7/2018 Kim ..... G09G 3/3233

FOREIGN PATENT DOCUMENTS

KR 20150071546 A 6/2015
KR 20180067106 A 6/2018
KR 20200053785 A 5/2020
KR 20200058702 A 5/2020
KR 20200077316 A 6/2020

* cited by examiner

*Primary Examiner* — Mihir K Rayan
(74) *Attorney, Agent, or Firm* — Polsinelli PC

(57) ABSTRACT

Provided are a display driving device capable of accurately detecting characteristics of pixels of a display panel regardless of an offset of an amplifier, and a display device including the same. The display device includes a display panel including pixels and a display driving device including a sense circuit configured to detect pixel signals from the pixels. The sense circuit includes sense amplifiers configured to provide the first reference voltage to the pixels so that the pixels are programmed using a first reference voltage in a programming mode.

20 Claims, 4 Drawing Sheets

DISPLAY DRIVING DEVICE AND DISPLAY DEVICE INCLUDING THE SAME

BACKGROUND

1. Technical Field

The present disclosure relates to a display device, and more particularly, to a display driving device capable of accurately detecting characteristics of a panel and a display device including the same.

2. Related Art

In general, a display device includes a display panel, a display driving device, a timing controller, etc.

The display driving device converts digital image data, provided from the timing controller, into a source signal, and provides the source signal to the display panel. The display driving device may be integrated into a single chip, and a plurality of display driving devices may be configured by considering the size and resolution of the display panel.

Furthermore, the display driving device detects the signal of each pixel in order to compensate for characteristics of the display panel, converts the signal into digital data, and provides the digital data to the timing controller.

A display driving device according to a conventional technology uses a source amplifier and a sense amplifier in order to detect the signal of each pixel. Such a conventional technology has a problem in that characteristics of pixels cannot be accurately detected because the source amplifier and the sense amplifier have different offsets.

The conventional technology has a problem in that the complexity of circuits is increased because an auto-zeroing circuit and a timing circuit are added to compensate for an offset of the amplifier.

Furthermore, the conventional technology has a problem in that characteristics of pixels cannot be accurately compensated for because an offset of the amplifier is not perfectly removed although an additional circuit for compensating for the offset is used.

SUMMARY

Various embodiments are directed to providing a display driving device capable of accurately detecting characteristics of pixels of a display panel regardless of an offset of an amplifier, and a display device including the same.

In an embodiment, a display device may include a display panel including pixels and a display driving device including a sense circuit configured to detect pixel signals from the pixels. The sense circuit may include sense amplifiers configured to provide a first reference voltage to the pixels so that the pixels are programmed using the first reference voltage in a programming mode.

In an embodiment, a display driving device may include a sense circuit configured to detect pixel signals from pixels of a display panel. The sense circuit may include sense amplifiers configured to provide a first reference voltage to the pixels so that the pixels are programmed using the first reference voltage in a programming mode.

In an embodiment, a display device may include a display panel including pixels, a display driving device including a sense circuit configured to detect pixel signals from the pixels, wherein the sense circuit includes sense amplifiers configured to provide a first reference voltage to the pixels so that the pixels are programmed using the first reference voltage in a programming mode, and a controller configured to control the pixels and the sense amplifiers in an initialization mode in which the pixels are initialized, the programming mode in which the pixels are programmed, and a sensing mode in which the pixel signals are detected.

DETAILED DESCRIPTION

Embodiments provide a display driving device capable of accurately detecting characteristics of pixels of a display panel regardless of an offset of an amplifier, and a display device including the same.

In embodiments, a sense period may be defined as a period in which a pixel characteristic is detected from a display panel 100. A display period may be defined as a period in which a source signal corresponding to digital image data is provided to the display panel 100.

In embodiments, the sense period may be divided into an initialization mode, a programming mode, and a sensing mode. The initialization mode may be defined as a task for initializing pixels. The programming mode may be defined as a task for programming pixels using a reference voltage of a sense amplifier 22 after the initialization mode. The sensing mode may be defined as a task for detecting pixel signals from pixels after the programming mode.

In embodiments, a reference voltage $V_{SENSE}$ applied to the reference voltage terminal of the sense amplifier 22 may be applied as a first reference voltage VDATA1 in the programming mode, and may be applied as a second reference voltage VDATA0 in the sensing mode. In this case, the second reference voltage VDATA0 may be set as a lower level than the first reference voltage VDATA1.

Figure 1:
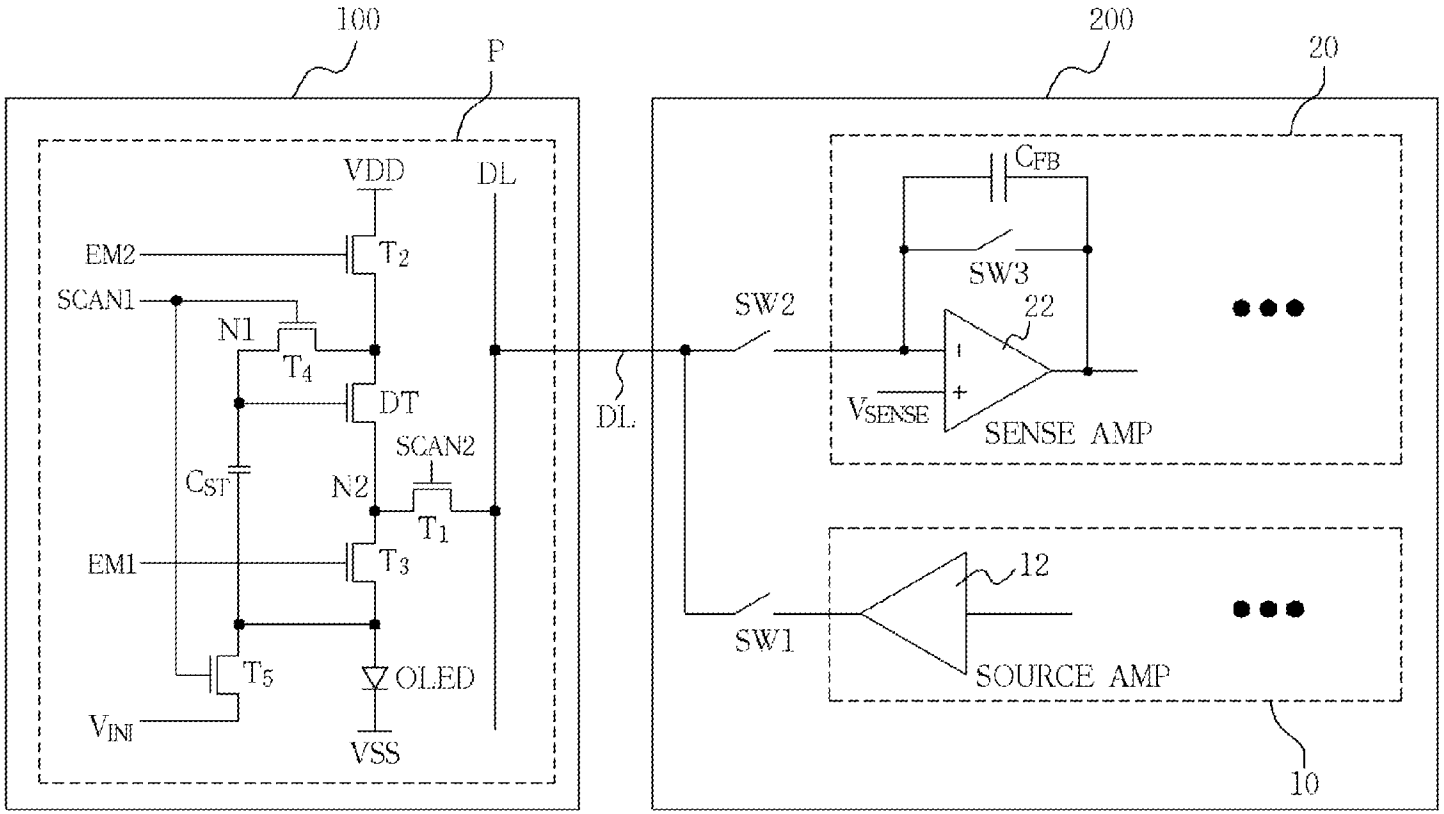
FIG. 1 is a circuit diagram of a display device according to an embodiment.

FIG. 1 is a circuit diagram of a display device according to an embodiment.

Referring to FIG. 1, the display device includes the display panel 100 and a display driving device 200.

The display panel 100 includes data lines DL and gate lines (not illustrated), and has pixels P formed at the intersections of the data lines DL and the gate lines. The embodiment illustrates the display device that implements the pixel by using an organic light emitting diode (OLED). The embodiment illustrates the display device for detecting a pixel signal through the data line DL. FIG. 1 illustrates only one pixel for convenience of description.

Each of the pixels P includes an OLED and a driving transistor DT. The driving transistors DT and OLEDs of the pixels P may have different characteristics in a threshold voltage, mobility, etc. If the driving transistors DT of the pixels have different characteristics, currents flowing into the driving transistors DT of the pixels may be different although the same source signal is applied to the pixels.

Furthermore, the OLEDs and driving transistors of the pixels of the display panel 100 may deteriorate as a driving time elapses. Accordingly, a deviation in characteristic may occur between the pixels.

The present embodiments provide a display device capable of accurately detecting characteristics of the pixels P of the display panel 100 regardless of offsets of a source amplifier 12 and the sense amplifier 22.

First, each of the pixels P of the display panel 100 includes an OLED, a driving transistor DT, first to fifth transistors T1 to T5, and a capacitor $C_{ST}$.

The driving transistor DT makes the OLED emit light by supplying a current to the OLED. A current flowing into the driving transistor DT and the OLED may be controlled in response to a source signal applied from a driving circuit 10.

The first transistor T1 couples the source terminal of the driving transistor DT and the data line DL. The first transistor T1 may be turned on in the programming mode and the sensing mode.

The second transistor T2 couples the drain terminal of the driving transistor DT and a first power supply voltage terminal. The second transistor T2 may be turned on in the initialization mode and the sensing mode. A first power supply voltage VDD may be applied to the first power supply voltage terminal, and may be used to initialize a pixel in the initialization mode.

The third transistor T3 couples the source terminal of the driving transistor DT and the OLED. The third transistor T3 may be turned off in the sense period, and may be turned on in the display period.

The fourth transistor T4 couples the drain terminal of the driving transistor DT and the gate terminal of the driving transistor DT. The fourth transistor T4 may be turned on in the initialization mode and the programming mode.

The capacitor $C_{ST}$ has one end coupled to the fourth transistor T4 and the gate terminal of the driving transistor DT, and has the other end coupled to the fifth transistor T5. The capacitor $C_{ST}$ stores charges. The capacitor $C_{ST}$ may store charges, corresponding to the first power supply voltage VDD, in the initialization mode. Furthermore, the capacitor $C_{ST}$ may store charges, corresponding to a source signal, in the display period.

The fifth transistor T5 couples the other end of the capacitor $C_{ST}$ and an initial voltage terminal. The fifth transistor T5 may be turned on in the initialization mode and the programming mode. An initial voltage VINI may be applied to the initial voltage terminal. The initial voltage VINI may be used to form a current path between the first power supply voltage terminal and the initialization voltage terminal in the initialization mode and the programming mode.

The OLED has one end coupled to the third transistor T3 and the other end coupled to a second power supply voltage terminal. A second power supply voltage VSS may be applied to the second power supply voltage terminal. Furthermore, the other end of the capacitor $C_{ST}$ and one end of the OLED are coupled.

The initial voltage VINI may be set as a level lower than or equal to that of the second power supply voltage VSS so that a current path is formed between the first power supply voltage terminal and the initialization voltage terminal in the initialization mode and in the programming mode.

The display driving device 200 includes the driving circuit 10 and a sense circuit 20.

In the display period, the driving circuit 10 receives digital image data from a timing controller (not illustrated), converts the digital image data into a source signal, and provides the source signal to the display panel 100. The driving circuit 10 may include a latch, a digital analog converter, and the source amplifiers 12.

The sense circuit 20 programs pixels in the programming mode of the sense period, and detects pixel signals from the pixels P in the sensing mode of the sense period. The sense circuit 20 may include the sense amplifiers 22. The sense amplifiers 22 may be coupled to the data lines DL, respectively. FIG. 1 illustrates only one sense amplifier 22 and one source amplifier 12, for convenience of description.

The sense amplifier 22 may provide the first reference voltage VDATA1 to the pixel P in the programming mode. First and second nodes N1 and N2 of the pixel P may be programmed using the first reference voltage VDATA1 provided from the sense amplifier 22. For example, the first node N1 of the pixel P may be programmed using the sum of the first reference voltage VDATA1 and the threshold voltage of the driving transistor DT. The second node N2 of the pixel P may be programmed using the first reference voltage VDATA1.

The sense amplifier 22 may operate as a unit gain amplifier in the programming mode. In the programming mode, the sense amplifier 22 may have a negative input stage (−) and an output stage coupled by the turn-on of a third switch SW3, and may provide the data line DL of the pixel P with the first reference voltage VDATA1 applied to a positive input stage (+) of the sense amplifier 22.

Furthermore, the sense amplifier 22 may operate as an integrator in the sensing mode. In the sensing mode, the sense amplifier 22 may provide the data line DL of the pixel P with the second reference voltage VDATA0 applied to the positive input stage (+) of the sense amplifier 22, may be coupled in parallel to a feedback capacitor $C_{FB}$ by the turn-off of the third switch SW3, and may operate as the integrator.

In this case, the second reference voltage VDATA0 may be set as a lower level than the first reference voltage VDATA1. Furthermore, a first switch SW1 may be turned on in the display period, and may be turned off in the sense period. A second switch SW2 and the third switch SW3 may be turned off in the display period, and may be turned on or off depending on the programming mode and the sensing mode in the sense period.

Furthermore, the display device may include a controller (not illustrated) for controlling the first to fifth transistors T1 to T5 of the pixel P of the display panel 100 and the first to third switches SW1 to SW3 of the display driving device 200.

The controller may initialize the first node N1 with the first power supply voltage VDD by turning off the first and third transistors T1 and T3 of the pixel P and turning on the second, fourth and fifth transistors T2, T4 and T5 of the pixel P in the initialization mode.

The controller may program the first node N1 using the sum of the first reference voltage VDATA1 and the threshold voltage of the driving transistor DT by turning off the second and third transistors T2 and T3 of the pixel P and turning on the first, fourth and fifth transistors T1, T4 and T5 of the pixel P in the programming mode.

The controller may control the detection of a pixel signal by turning off the third, fourth and fifth transistors T3, T4 and T5 of the pixel P and turning on the first and second transistors T1 and T2 of the pixel P in the sensing mode.

Figure 2:
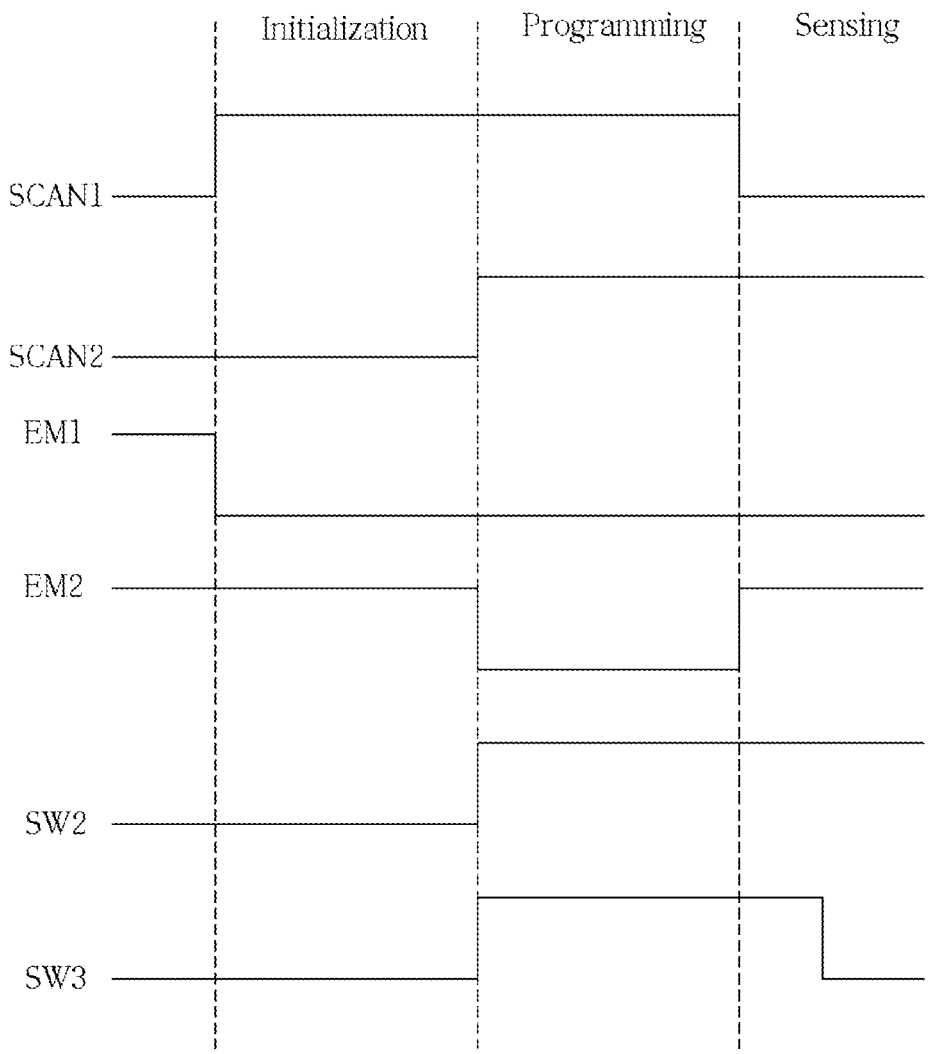
FIG. 2 is a timing diagram of the display device according to an embodiment.

FIG. 2 is a timing diagram of the display device according to an embodiment.

Referring to FIGS. 1 and 2, the display device may be divided and operated into the initialization mode, the programming mode, and the sensing mode during the sense period in which characteristics of the display panel 100 are detected.

In the initialization mode, a first scan signal SCAN1 and a second control signal EM2 are enabled, and a second scan signal SCAN2 and a first control signal EM1 are disabled. Furthermore, the first and third transistors T1 and T3 of the pixel P are turned off, and the second, fourth and fifth transistors T2, T4 and T5 thereof are turned on. Accordingly, the first node N1 may have a level of the first power supply voltage VDD in the initialization mode.

In the programming mode, the first and second scan signals SCAN1 and SCAN2 are enabled, and the first and second control signals EM1 and EM2 are disabled. Furthermore, the second and third switches SW2 and SW3 are turned on. Furthermore, the second and third transistors T2 and T3 of the pixel P are turned off, and the first, fourth and fifth transistors T1, T4 and T5 thereof are turned on. Accordingly, in the programming mode, the first node N1 may be programmed using the sum of the first reference voltage VDATA1 and the threshold voltage of the driving transistor DT.

In the sensing mode, the second scan signal SCAN2 and the second control signal EM2 are enabled, and the first scan signal SCAN1 and the first control signal EM1 are disabled. Furthermore, the second switch SW2 is turned on. The third switch SW3 provides the data line DL of the pixel P with the second reference voltage VDATA0 applied to the sense amplifier 22, and is then turned off. In this case, in the sensing mode, the switch SW3 may be turned off in the middle of the sensing mode so that an unwanted value is not integrated. Furthermore, the third, fourth and fifth transistors T3, T4 and T5 of the pixel P are turned off, and the first and second transistors T1 and T2 thereof are turned on.

Accordingly, in the sensing mode, the second node N2 has a level of the second reference voltage VDATA0. The gate of the driving transistor DT may be set as the sum of the first reference voltage VDATA1 and the threshold voltage of the driving transistor DT. The source of the driving transistor DT may be set as the second reference voltage VDATA0. Next, in the sensing mode, the sense amplifier 22 of the sense circuit 20 may operate as an integrator, may integrate a current flowing into the data line DL, and may detect a pixel signal.

Figure 3:
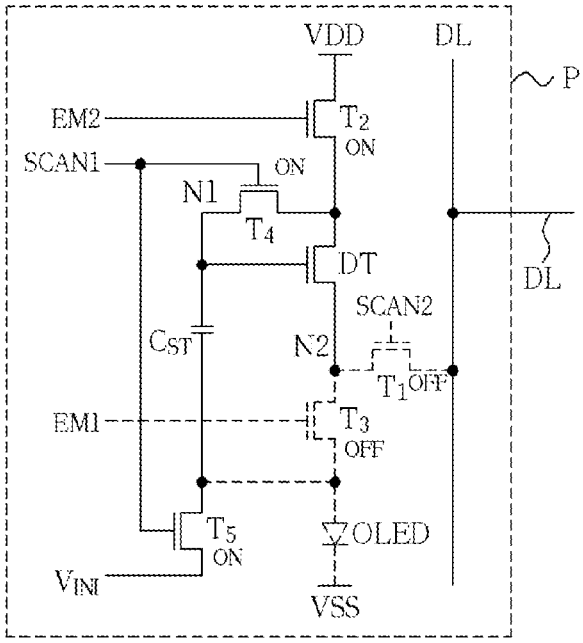
FIG. 3 is a circuit diagram illustrating an operating state of a pixel in an initialization mode.

FIG. 3 is a pixel circuit illustrating an operating state in the initialization mode.

Referring to FIGS. 2 and 3, in the initialization mode, a current path is formed between the first power supply voltage terminal and the initial voltage terminal by the turn-off of the first and third transistors T1 and T3 of the pixel P and the turn-on of the second, fourth and fifth transistors T2, T4 and T5 of the pixel P.

The first node N1 may be initialized as a level of the first power supply voltage VDD through the current path formed between the first power supply voltage terminal and the initial voltage terminal.

Figure 4:
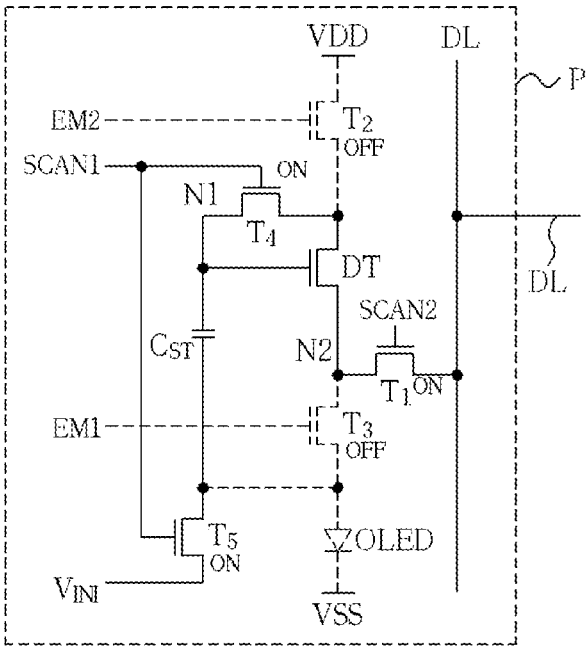
FIG. 4 is a circuit diagram illustrating an operating state of a pixel in a programming mode.

FIG. 4 is a pixel circuit illustrating an operating state in the programming mode.

Referring to FIGS. 2 and 4, in the programming mode, the pixel P may be programmed using the first reference voltage VDATA1, provided from the sense amplifier 22, by the turn-off of the second and third transistors T2 and T3 and the turn-on of the first, fourth and fifth transistors T1, T4 and T5.

In this case, the sense circuit 20 may operate as a unit gain amplifier by the turn-on of the second and third switches SW2 and SW3, and may provide the first reference voltage VDATA1 to the pixel P.

Accordingly, the first node N1 may be programmed using the sum of the first reference voltage VDATA1 and the threshold voltage of the driving transistor DT.

Figure 5:
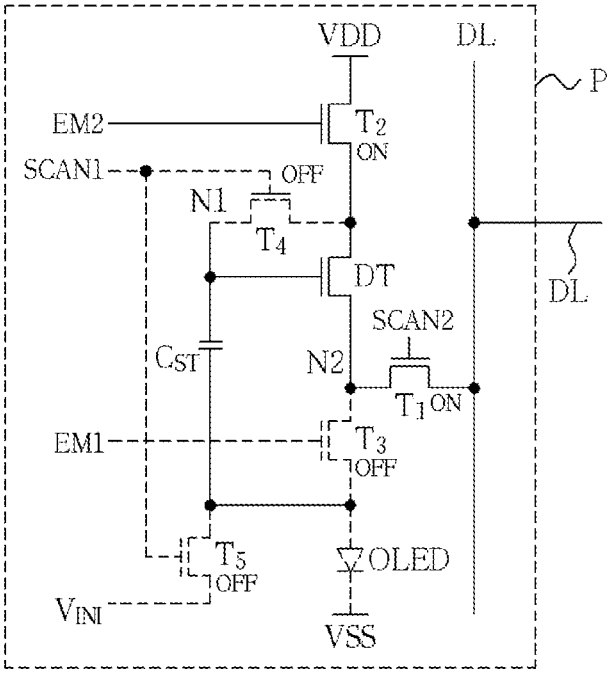
FIG. 5 is a circuit diagram illustrating an operating state of a pixel in a sensing mode.

FIG. 5 is a pixel circuit illustrating an operating state in the sensing mode.

Referring to FIGS. 2 and 5, a pixel signal from the pixel P may be provided to the sense circuit 20 through the data line DL by the turn-off of the third, fourth and fifth transistors T3, T4 and T5 and the turn-on of the first and second transistors T1 and T2. In this case, the sense circuit 20 may operate as an integrator by the turn-on of the second switch SW2 and the turn-off of the third switch SW3, and may detect the pixel signal.

As described above, according to embodiments, pixel signals are detected after being programmed using the first reference voltage VDATA1 of the sense amplifier 22. Accordingly, characteristics of the pixels P of the display panel 100 can be accurately detected regardless of an offset of the sense amplifier 22 of the sense circuit 20.

Furthermore, according to embodiments, a deviation between characteristics of the pixels P attributable to deterioration can be accurately compensated for because the characteristics of the pixels P of the display panel 100 can be accurately detected.

Furthermore, according to embodiments, the sense circuit 20 can be simplified because an auto-zeroing circuit and a timing circuit do not need to be added in order to compensate for an offset of the sense amplifier 22.

While various embodiments have been described above, it will be understood to those skilled in the art that the embodiments described are by way of example only. Accordingly, the disclosure described herein should not be limited based on the described embodiments.

What is claimed is:

1. A display device comprising:

a display panel comprising pixels; and a display driving device comprising a sense circuit configured to detect pixel signals from the pixels, wherein the sense circuit comprises sense amplifiers configured to provide a first reference voltage to the pixels so that the pixels are programmed using the first reference voltage in a programming mode, wherein each of the pixels comprises:

an organic light emitting diode (OLED); and a driving transistor configured to supply a current to the OLED, wherein the pixels are programmed using a sum of the first reference voltage and a threshold voltage of the driving transistor in the programming mode subsequent to an initialization mode.

2. The display device of claim 1, wherein the sense amplifier operates as a unit gain amplifier in the programming mode.

3. The display device of claim 2, wherein in the programming mode, the sense amplifier has a negative input stage and an output stage coupled, and provides a data line of the pixel with the first reference voltage applied to a positive input stage of the sense amplifier.

4. The display device of claim 1, wherein the sense amplifier operates as an integrator in a sensing mode subsequent to the programming mode.

5. The display device of claim 4, wherein the sense amplifier operates as the integrator after providing a data line of the pixel with a second reference voltage applied to a positive input stage of the sense amplifier in the sensing mode.

6. The display device of claim 5, wherein the second reference voltage is set as a lower level than the first reference voltage.

7. The display device of claim 1, wherein each of the pixels and the sense amplifier are coupled through a data line.

8. The display device of claim 1, wherein each of the pixels comprises:

a first transistor configured to couple a source terminal of the driving transistor and a data line;

a second transistor configured to couple a drain terminal of the driving transistor and a first power supply voltage terminal;

a third transistor configured to couple the source terminal of the driving transistor and the OLED;

a fourth transistor configured to couple the drain terminal of the driving transistor and a gate terminal of the driving transistor;

a capacitor configured to have one end coupled to the fourth transistor and the gate terminal and the other end coupled to a fifth transistor and to store charges; and the fifth transistor configured to couple the other end of the capacitor and an initial voltage terminal, wherein the OLED has one end coupled to the third transistor and the other end coupled to a second power supply voltage terminal, and the other end of the capacitor and the one end of the OLED are coupled.

9. The display device of claim 8, wherein an initial voltage of the initial voltage terminal is set as a level equal to or lower than a level of a second power supply voltage of the second power supply voltage terminal.

10. The display device of claim 8, wherein in the initialization mode, a first node of the gate terminal is initialized as a first power supply voltage by turning off the first and third transistors and turning on the second, fourth and fifth transistors.

11. The display device of claim 10, wherein in the programming mode subsequent to the initialization mode, the first node of the gate terminal is programmed using a sum of the first reference voltage and a threshold voltage of the driving transistor by turning off the second and third transistors and turning on the first, fourth and fifth transistors.

12. The display device of claim 11, wherein in the sensing mode subsequent to the programming mode, the pixel signal is detected by turning off the third, fourth and fifth transistors and turning on the first and second transistors.

13. A display driving device comprising:

a sense circuit configured to detect pixel signals from pixels of a display panel, wherein the sense circuit comprises a sense amplifiers configured to provide a first reference voltage to the pixels so that the pixels are programmed using the first reference voltage in a programming mode, wherein each of the pixels comprises:

an organic light emitting diode (OLED); and a driving transistor configured to supply a current to the OLED, wherein the pixels are programmed using a sum of the first reference voltage and a threshold voltage of the driving transistor in the programming mode subsequent to an initialization mode.

14. The display driving device of claim 13, wherein the sense amplifier transmits the first reference voltage to a data line of the pixel in the programming mode.

15. The display driving device of claim 14, wherein the sense amplifier detects the pixel signal through the data line in a sensing mode subsequent to the programming mode.

16. The display driving device of claim 13, wherein in the programming mode, the sense amplifier operates as a unit gain amplifier and provides a data line of the pixel with the first reference voltage applied to an input stage of the sense amplifier.

17. The display driving device of claim 13, wherein in a sensing mode subsequent to the programming mode, the sense amplifier provides a second reference voltage to a data line of the pixel and operates as an integrator.

18. The display driving device of claim 17, wherein the second reference voltage is set as a lower level than the first reference voltage.

19. A display device comprising:

a display panel comprising pixels;

a display driving device comprising a sense circuit configured to detect pixel signals from the pixels, wherein the sense circuit comprises a sense amplifiers configured to provide a first reference voltage to the pixels so that the pixels are programmed using the first reference voltage in a programming mode; and a controller configured to control the pixels and the sense circuit in an initialization mode in which the pixels are initialized, the programming mode in which the pixels are programmed, and a sensing mode in which the pixel signals are detected;

wherein each of the pixels comprises:

an organic light emitting diode (OLED); and a driving transistor configured to supply a current to the OLED, wherein the pixels are programmed using a sum of the first reference voltage and a threshold voltage of the driving transistor in the programming mode subsequent to an initialization mode.

20. The display device of claim 19, wherein the controller controls the pixels so that the pixels are initialized using a first power supply voltage in the initialization mode, controls the pixels and the sense amplifier so that the pixels are programmed using the first reference voltage of the sense amplifier in the programming mode, and controls the pixels and the sense amplifier so that the pixel signals are detected by the sense amplifier in the sensing mode.

* * * * *